US008444143B2

(12) United States Patent
Katsura et al.

(10) Patent No.: US 8,444,143 B2
(45) Date of Patent: May 21, 2013

(54) SHEET TRANSPORT APPARATUS

(75) Inventors: Norichika Katsura, Osaka (JP); Tadasu Taniguchi, Osaka (JP); Masahiko Fujita, Osaka (JP); Masaya Asakawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 92 days.

(21) Appl. No.: 12/501,743

(22) Filed: Jul. 13, 2009

(65) Prior Publication Data

US 2010/0013147 A1 Jan. 21, 2010

(30) Foreign Application Priority Data

Jul. 15, 2008 (JP) ..... 2008-183939

(51) Int. Cl.
*B65H 5/00* (2006.01)

(52) U.S. Cl.
USPC ..... 271/264; 271/272

(58) Field of Classification Search
USPC ..... 271/242, 245, 264, 272
See application file for complete search history.

(56) References Cited

U.S. PATENT DOCUMENTS

| | | | | |
|---|---|---|---|---|
| 5,083,766 | A * | 1/1992 | Osawa | 271/121 |
| 5,417,415 | A * | 5/1995 | Murakami | 271/227 |
| 6,602,008 | B2 * | 8/2003 | Yamagishi et al. | 400/619 |

FOREIGN PATENT DOCUMENTS

| | | | |
|---|---|---|---|
| JP | 63-60863 | * | 3/1988 |
| JP | 2-127333 | * | 5/1990 |
| JP | 3-267226 | A | 11/1991 |
| JP | 5-208773 | * | 8/1993 |
| JP | 6-183084 | * | 7/1994 |
| JP | 6-191686 | * | 7/1994 |
| JP | 8-217310 | * | 8/1996 |
| JP | 9-278210 | * | 10/1997 |
| JP | 2001-341909 | * | 12/2001 |
| JP | 2005-154100 | A | 6/2005 |
| JP | 2005-335823 | A | 12/2005 |
| JP | 2006-138970 | A | 6/2006 |
| JP | 2007-131455 | A | 5/2007 |
| JP | 2007-279414 | A | 10/2007 |

* cited by examiner

*Primary Examiner* — Thomas Morrison
(74) *Attorney, Agent, or Firm* — Birch, Stewart, Kolasch & Birch, LLP

(57) ABSTRACT

In a sheet transport apparatus, coiled springs 82 are fitted in and supported by recess portions 81*b* at a bottom face 81*a* of a support frame 81 and recess portions 73*c* at an upper face 73*b* of an inner guide 73. In other words, most of the portions of the coiled spring 82 are enclosed inside the recess portions 81*b* of the support frame 81 and the recess portions 73*c* of the inner guide 73, and covered and hidden by side walls 81*f* of the recess portions 81*b* and side walls 73*d* of the recess portions 73*c*.

8 Claims, 7 Drawing Sheets

SHEET TRANSPORT APPARATUS

CROSS-REFERENCE TO RELATED APPLICATIONS

This application claims priority under 35 U.S.C. §119(a) on Patent Application No. 2008-183939 filed in Japan on Jul. 15, 2008, the entire contents of which are herein incorporated by reference.

BACKGROUND OF THE INVENTION

The present invention relates to a sheet transport apparatus that transports sheets.

For example, in electrophotographic image forming apparatuses, an electrostatic latent image is formed on the surface of a photosensitive drum; a toner image is formed on the surface of the photosensitive drum by developing the electrostatic latent image on the surface of the photosensitive drum using a developer; the toner image is transferred from the photosensitive drum to a sheet while the sheet sandwiched in a nip region between the photosensitive drum and a transfer member is being transported; and the sheet is heated and pressed, thereby fixing the toner image on the sheet.

In such image forming apparatuses, a sheet transport apparatus is incorporated, and the sheet is drawn out from a paper feeding tray and transported by such a sheet transport apparatus. In a transport path of the sheet transport apparatus, a registration roller (also called PS (Paper Stop) roller) is provided at an upstream side of the nip region between the photosensitive drum and the transfer member in the sheet transportation direction. The sheet is transported to the nip region by the registration roller after the leading edge of the sheet is put against the registration roller so as to flex the sheet so that the leading edge of the sheet is arranged in parallel to the registration roller due to the flexibility of the sheet. This prevents the sheet from obliquely passing through the nip region, avoiding obliquely transferring of the toner image onto the sheet.

Furthermore, in JP 2005-154100A (in the following, Patent Document 1), a guide member for sheets is biased by a spring at an upstream side of the registration roller in the sheet transportation direction, and the guide member effectively presses the leading edge of the sheet toward the registration roller, so that the leading edge of the sheet is reliably arranged by the registration roller.

Meanwhile, sheet blockage during transportation of the sheet, called a "jam", may occur in sheet transport apparatuses. Thus, the apparatus is made so that a plurality of portions of the apparatus can be opened, and the blocked sheet can be removed at the opened portion.

However, when the portion provided with springs biasing the guide member for sheets as in Patent Document 1 is opened, it is possible that the user may touch the springs and, therefore, the springs may be removed or the spring itself may be damaged by careless operations and the like, causing failures in the apparatus.

SUMMARY OF THE INVENTION

The present invention has been devised in light of the above-described conventional problems, and aims to provide a sheet transport apparatus in which it is difficult to make contact with the spring biasing the guide member even if the portion in the proximity of the guide member is opened.

To solve the above-described problems, in a sheet transport apparatus of the present invention, a guide member that forms a portion of a sheet transport path is elastically positioned by a spring and a portion in the proximity of the guide member can be opened for maintenance of the apparatus; a recess portion for supporting one end of the spring is formed in the guide member, and a recess portion for supporting the other end of the spring is formed in a support member of the guide member; and the spring is disposed and enclosed inside the recess portion of the guide member and the recess portion of the support member, thereby sandwiching the spring between the guide member and the support member.

The guide member is rotatably attached to the support member, and the spring is disposed and enclosed inside the recess portions by disposing one end or the other end of the spring in the recess portion of the guide member or in the recess portion of the support member, and then rotating the guide member so that the recess portion of the guide member and the recess portion of the support member face each other.

Furthermore, the guide member is removably attached to the support member, and the guide member is prohibited from moving in the directions of removal from and attachment to the support member when the support member is attached to an apparatus main unit.

EFFECTS OF THE INVENTION

According to the present invention, the springs are rarely exposed and the springs are prevented from being removed or being damaged by careless operations and the like even if the portion at which the springs are provided is opened, because the springs are disposed and enclosed inside the recess portion of the guide member and the recess portion of the support member.

Furthermore, the operation of mounting the springs is simple and easy because the springs are disposed and enclosed inside these recess portions by first disposing one end or the other end of the spring in the recess portion of the guide member or in the recess portion of the support member, and then rotating the guide member so as to allow the recess portion of the guide member and the recess portion of the support member to face each other.

Furthermore, with the support member attached to the apparatus main unit, the guide member cannot be moved in the directions of attachment to and removal from the support member. In this case, the guide member cannot be taken out unless the support member is taken out and, further, the springs cannot be taken out. Thus, it is difficult to remove or damage the springs.

DETAILED DESCRIPTION OF THE INVENTION

Hereinafter, embodiments of the present invention are described in detail with reference to the attached drawings.

Figure 1:
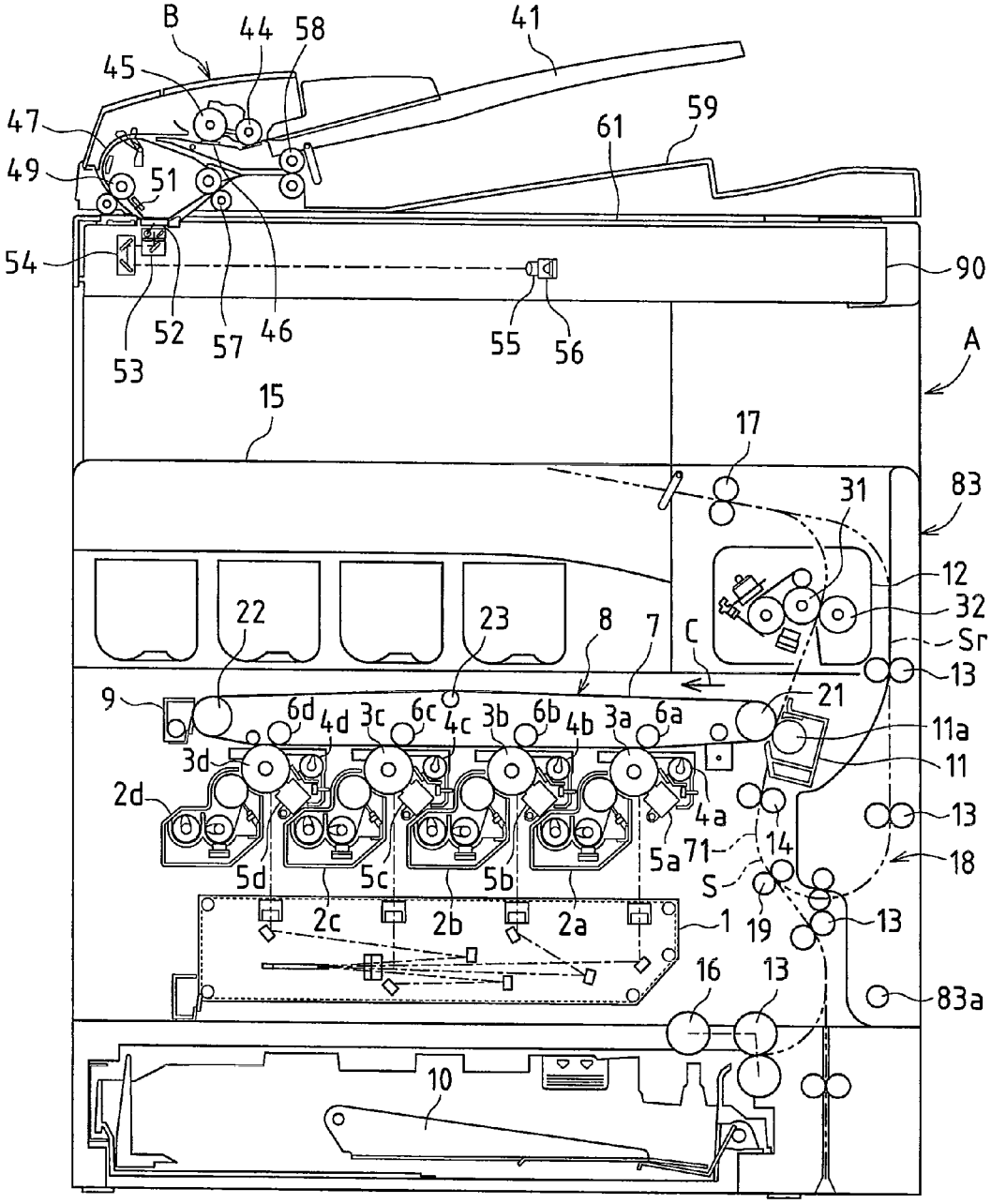
FIG. 1 is a side view illustrating an image forming apparatus in which an embodiment of the sheet transport apparatus of the present invention is applied.

FIG. 1 is a side view illustrating an image forming apparatus in which an embodiment of the sheet transport apparatus of the present invention is applied. The image forming apparatus is provided with an original reading apparatus B that reads images of the original, and an apparatus main unit A that records and forms the images of the original read by the original reading apparatus B or images received from outside on recording sheets in color or monochrome.

In the original reading apparatus B, when an original is set onto an original set tray 41, a pickup roller 44 is pressed against the surface of the original and rotated; the original is drawn out from the tray 41; and the original is transported to a transport path 47 after passing through between a separation roller 45 and a separation pad 46 and being separated into individual sheets of paper.

In the transport path 47, the leading edge of the original abuts registration rollers 49 so that the leading edge of the original and the registration rollers 49 are arranged in parallel, and then the original is transported by the registration rollers 49 and passes between a reading guide 51 and a reading glass 52. At this time, light from a light source of a first scanning unit 53 is applied to the surface of the original through the reading glass 52; reflected light therefrom enters the first scanning unit 53 through the reading glass 52; the reflected light is guided to an imaging lens 55 by being reflected on mirrors of the first scanning unit 53 and a second scanning unit 54; and the image of the surface of the original is formed on a CCD (Charge Coupled Device) 56 by the imaging lens 55. The CCD 56 reads images on the surface of the original, and outputs image data indicating the image on the surface of the original. Then, the original is transported by transport rollers 57, and discharged to a discharge tray 59 through discharge rollers 58.

An original that is placed on a platen glass 61 can also be read. The registration rollers 49, the reading guide 51, the discharge tray 59 and the like, and members that are above these are integrated into a cover unit that is pivoted at the rear side of the original reading apparatus B to allow opening and closing. By opening this upper side cover unit, the platen glass 61 is opened, and an original can be placed on the platen glass 61.

When the original is placed thereon and the cover unit is closed, the surface of the original on the platen glass 61 is exposed to light by the first scanning unit 53 while the first and the second scanning units 53 and 54 are moving in a sub-scanning direction. The reflected light from the surface of the original is guided to the imaging lens 55 by the first and the second scanning units 53 and 54, and an image of the surface of the original is formed on the CCD 56 by the imaging lens 55.

At this time, the first and the second scanning units 53 and 54 move while maintaining a predetermined speed relationship, and the positional relationship between the first and the second scanning units 53 and 54 is constantly maintained so as not to change the length of the optical path of the reflected light from the surface of the original to the first and the second scanning units 53 and 54, to the imaging lens 55, and to the CCD 56. By thus maintaining the positional relationship between the first and the second scanning units 53 and 54, the focus on the image on the surface of the original on the CCD 56 is always maintained accurately.

The entire image of the original thus read is sent to and received by the apparatus main unit A of the image forming apparatus as image data, and the image is recorded on a recording sheet at the apparatus main unit A.

Meanwhile, the apparatus main unit A of the image forming apparatus is configured from a laser exposure apparatus 1, a development apparatus 2, a photosensitive drum 3, a charging unit 5, a cleaner apparatus 4, an intermediate transfer belt apparatus 8, a fixing apparatus 12, a sheet transport apparatus 18, a paper feeding tray 10, a discharge tray 15, and the like.

Image data handled by the apparatus main unit A of the image forming apparatus is based on color images employing black (K), cyan (C), magenta (M), and yellow (Y), or monochrome images employing a single color (for example, black). Therefore, four for each of the development apparatus 2 (2*a*, 2*b*, 2*c*, and 2*d*), the photosensitive drum 3 (3*a*, 3*b*, 3*c*, and 3*d*), the charging unit 5 (5*a*, 5*b*, 5*c*, and 5*d*), and the cleaner apparatus 4 (4*a*, 4*b*, 4*c*, and 4*d*) are provided, corresponding to the respective colors so as to form latent images of four kinds, and a corresponds to black, b to cyan, c to magenta, and d to yellow, thus constituting four image-forming stations.

The photosensitive drums 3 are disposed approximately at the center of the apparatus main unit A.

The charging units 5 are charging means for charging the surfaces of the photosensitive drums 3 uniformly to a predetermined potential and, in addition to roller types or brush types of contact-type charging units, charger-type charging units can be used.

The laser exposure apparatus 1 is a laser scanning unit (LSU) including a laser diode and reflection mirrors, and exposes the surfaces of the charged photosensitive drums 3 to light in accordance with image data so as to form electrostatic latent images in accordance with the image data on the surfaces of the photosensitive drums.

The development apparatuses 2 develop the electrostatic latent images formed on the photosensitive drums 3 with toners (K, C, M, and Y). The cleaner apparatuses 4 remove and recover the toner that is left on the surfaces of the photosensitive drums 3 after development and image transfer.

The intermediate transfer belt apparatus 8 disposed above the photosensitive drums 3 is provided with an intermediate transfer belt 7, an intermediate transfer belt drive roller 21, an idler roller 22, intermediate transfer rollers 6 (6*a*, 6*b*, 6*c*, and 6*d*), and an intermediate transfer belt cleaning apparatus 9.

The intermediate transfer belt 7 is stretched across and supported by, for example, the intermediate transfer belt drive roller 21, the intermediate transfer rollers 6, and the idler roller 22, which allow the intermediate transfer belt 7 to go around in the direction of arrow C.

The intermediate transfer rollers 6 are supported in the proximity of the intermediate transfer belt 7 such that the intermediate transfer rollers 6 can rotate, pressed against the photosensitive drums 3 with the intermediate transfer belt 7 interposed therebetween, and are provided with a transfer bias for transferring the toner image on the photosensitive drums 3 to the intermediate transfer belt 7.

The intermediate transfer belt 7 is provided so as to contact the respective photosensitive drums 3*a*, 3*b*, 3*c*, and 3*d*, and a color toner image (a multicolor toner image) is formed by superimposing the respective toner images on the surfaces of the photosensitive drums 3*a*, 3*b*, 3*c*, and 3*d* and transferring the toner images in order to the intermediate transfer belt 7.

This transfer belt is formed as a belt having no end, using a film having a thickness of about 100 μm to 150 μm.

The transfer of the toner image from the photosensitive drums 3 to the intermediate transfer belt 7 is performed by the intermediate transfer rollers 6 that are pressed against the reverse side of the intermediate transfer belt 7. A high voltage transfer bias (a high voltage of a polarity (+) that is the opposite of the polarity (−) of the charged toner) for transferring the toner image is applied to the intermediate transfer rollers 6. The intermediate transfer rollers 6 are rollers that are based on a metal (for example, stainless steel) shaft having a diameter of 8 to 10 mm and whose surfaces are covered with a conductive elastic material (for example, EPDM, urethane foam, etc.). This conductive elastic material allows a high voltage to be applied uniformly to the recording sheet.

The toner images on the surfaces of the respective photosensitive drums 3*a*, 3*b*, 3*c*, and 3*d* as described above are laminated on the intermediate transfer belt 7 and become a color toner image of the image data. The laminated toner image of each color is transported with the intermediate transfer belt 7, and transferred onto a recording sheet by a secondary transfer apparatus 11 that is in contact with the intermediate transfer belt 7.

The intermediate transfer belt 7 and a transfer roller 11*a* of the secondary transfer apparatus 11 are pressed against each other, forming a nip region. Also, a voltage (a high voltage of a polarity (+) that is the opposite of the polarity (−) of the charged toner) is applied to the transfer roller 11*a* of the secondary transfer apparatus 11 to transfer the toner image of each color on the intermediate transfer belt 7 to the recording sheet. Further, in order to constantly obtain the above nip region, a hard material (such as metal) is used for either the transfer roller 11*a* of the secondary transfer apparatus 11 or the intermediate transfer belt drive roller 21, and a soft material of an elastic roller or the like (such as an elastic rubber roller or a foam resin roller) is used for the other.

Also, toner may sometimes remain on the intermediate transfer belt 7 without the toner images on the intermediate transfer belt 7 being completely transferred onto the recording sheet by the secondary transfer apparatus 11, and this residual toner causes toner color mixing in the next step. Thus, the residual toner is removed and recovered by the intermediate transfer belt cleaning apparatus 9. The intermediate transfer belt cleaning apparatus 9, for example, is provided with a cleaning blade that makes contact with the intermediate transfer belt 7 and is used as a cleaning member, and at the position where the cleaning blade makes contact, the intermediate transfer belt 7 is supported from the back side of the belt 7 by the idler roller 22.

The paper feeding tray 10 is a tray for storing recording sheets, and is provided below the image forming portion of the apparatus main unit A. Also, the discharge tray 15, provided above the image forming portion, is a tray in which a recording sheet whose printing has been finished is placed face down.

Also, in the apparatus main unit A, a sheet transport apparatus 18 is provided for feeding a recording sheet in the paper feeding tray 10 through the secondary transfer apparatus 11 and the fixing apparatus 12 to the discharge tray 15. The sheet transport apparatus 18 is provided with an S-shaped sheet transport path S, and a pickup roller 16, pre-registration rollers 19, registration rollers 14, the fixing apparatus 12, transport rollers 13, and discharge rollers 17 are disposed along the sheet transport path S.

The pickup roller 16 is provided in the end portion of the paper feeding tray 10, and is a pull-in roller that supplies recording sheets one by one from the paper feeding tray 10 to the sheet transport path S. The transport rollers 13 and the pre-registration rollers 19 are small rollers for promoting and helping transportation of the recording sheet, and such rollers are provided at a plurality of positions along the sheet transport path S.

The registration rollers 14 temporarily hold the recording sheet being transported, align the leading edge of the recording sheet, and transport the recording sheet so that the color toner image on the intermediate transfer belt 7 is transferred to the recording sheet at the nip region between the intermediate transfer belt 7 and the secondary transfer apparatus 11 with good timing matched with the rotation of the photosensitive drums 3 and the intermediate transfer belt 7.

For example, the registration rollers 14 transport the recording sheet such that the leading edge of the color toner image on the intermediate transfer belt 7 matches the leading edge of the image forming area on the recording sheet in the nip region between the intermediate transfer belt 7 and the secondary transfer apparatus 11.

The fixing apparatus 12 receives the recording sheet to which the toner image is transferred, and transports the recording sheet by sandwiching the sheet between a heat roller 31 and a pressure roller 32.

The heat roller 31 is set to a predetermined fixing temperature, and has the functions of melting, mixing, and pressing toner images transferred onto the recording sheet so that the images are thermally fixed onto the recording sheet by subjecting the sheet to thermocompression bonding in cooperation with the pressure roller 32.

The recording sheet on which the multicolor toner images are fixed is discharged onto the discharge tray 15 by the discharge rollers 17.

It is also possible to form a monochrome image by using only a single image-forming station, and transferring the monochrome image to the intermediate transfer belt 7 of the intermediate transfer belt apparatus 8. Such a monochrome image is also transferred from the intermediate transfer belt 7 to the recording sheet, as in the case with color images, and fixed onto the recording sheet.

Furthermore, when not only the front face but both faces of the recording sheet are to be printed, after fixing the image on the front face of the recording sheet with the fixing apparatus 12, during the transportation of the recording sheet by the discharge rollers 17 in the sheet transport path S, the discharge rollers 17 are stopped and then rotated in reverse; the recording sheet is passed into a reverse path Sr; the recording sheet is turned over so as to reverse the front and reverse faces; the recording sheet is guided to the registration rollers 14; images are recorded and fixed onto the reverse face of the recording sheet as in the case with the front face of the recording sheet; and the recording sheet is discharged to the discharge tray 15.

Hereinafter, a configuration of the sheet transport apparatus 18 is described in detail. In the sheet transport apparatus 18, a curved portion 71 of the sheet transport path S being curved with a large curvature is formed at an upstream side of the registration rollers 14 in the sheet transportation direction. In such a curved portion 71, sheets tend to be blocked as the recording sheet becomes more inflexible.

Figure 2:
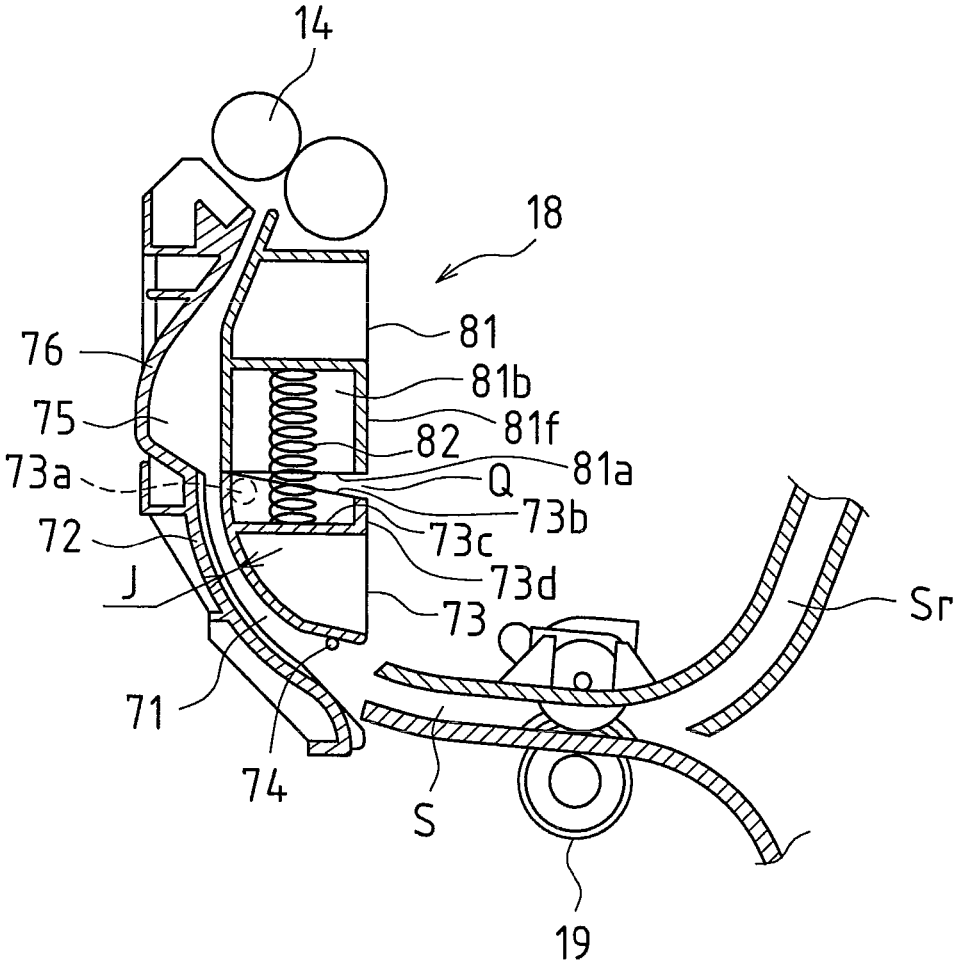
FIG. 2 is a cross-sectional view illustrating the proximity of a curved portion of a sheet transport path in the sheet transport apparatus of FIG. 1.

Thus, in the sheet transport apparatus 18, the curved portion 71 is configured as shown in FIG. 2 so as not to easily cause sheet blockage even if the recording sheet is inflexible.

As shown in FIG. 2, the curved portion 71 in the sheet transport path S is formed between an outer guide 72 and an inner guide 73. The curved portion 71 of the sheet transport path S is positioned at an upstream side of the registration rollers 14 and a downstream side of the pre-registration rollers 19 in the sheet transportation direction.

The outer guide 72 is fixed. The inner guide 73 is supported by pins 73*a* so as to be swingable. A coiled spring 82 is inserted between a support frame 81 of the sheet transport path S and an upper face 73*b* of the inner guide 73. The inner guide 73 rotates in the clockwise direction around the pins 73*a* due to elasticity of the coiled spring 82 and the end portion of the inner guide 73 abuts a stopper 74, thereby positioning the inner guide 73. The stopper 74 is fixed on the wall face at the back of the curved portion 71, and does not contact or interfere with a recording sheet that passes through the curved portion 71.

Also, a flexure space 75 that is formed by widening the width of the sheet transport path S is provided between the registration rollers 14 and the curved portion 71 so that a recording sheet that is abutted against the registration rollers 14 and flexed is accommodated therein. The flexure space 75 is formed by curving and denting the guide 76 of the sheet transport path S.

Although the curvature of the curved portion 71 can be decreased by enlarging the flexure space 75 to the lower direction to link with the curved portion 71, it is not preferable to excessively enlarge the flexure space 75 because transportation precision of the recording sheet deteriorates.

Figure 3A:
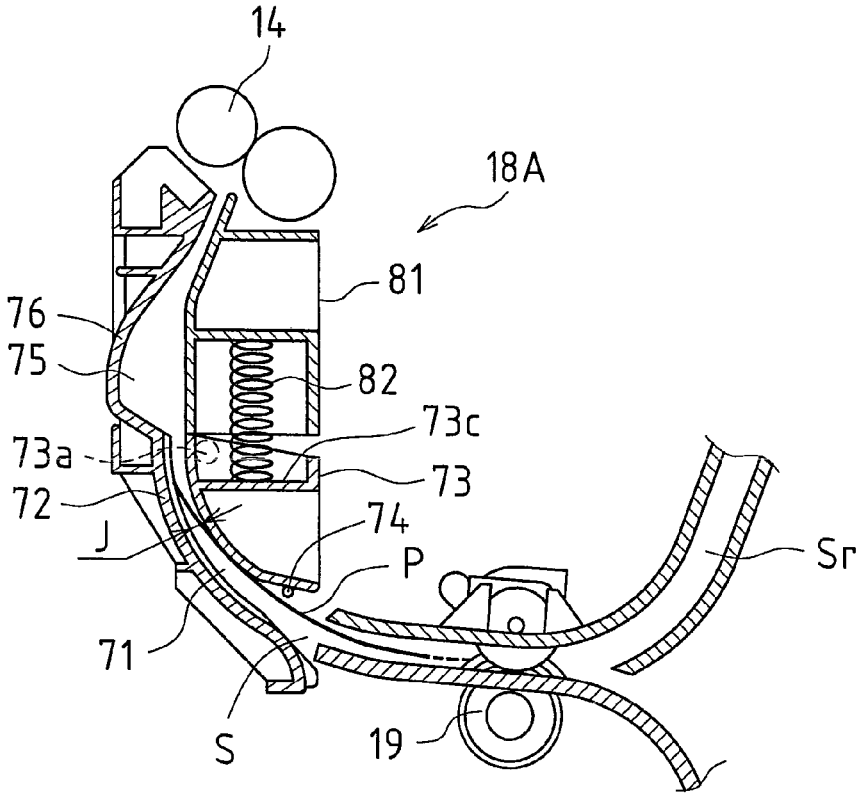
FIG. 3A is a diagram illustrating a standard recording sheet of about 64 g/m$^2$ (grammage) passing through the curved portion of the sheet transport path of FIG. 2.

In such a curved portion 71 of the sheet transport path S, when the end portion of the inner guide 73 abuts the stopper 74, a path width J between the outer guide 72 and the inner guide 73 is constant. When a standard recording sheet P of about 64 g/m$^2$ (grammage) is transported to the curved portion 71 through the pre-registration rollers 19 under such a state as shown in FIG. 3A, because the recording sheet P is sufficiently flexible, the recording sheet P easily flexes along with the curved portion 71, and the recording sheet P passes through the curved portion 71 smoothly.

At this time, even if the recording sheet P is in contact with the inner guide 73, a degree of force that displaces the inner guide 73 does not affect the inner guide 73, and the recording sheet P is transported while the path width J between the outer guide 72 and the inner guide 73 is kept constant, maintaining the transportation precision of the recording sheet P high.

Figure 3B:
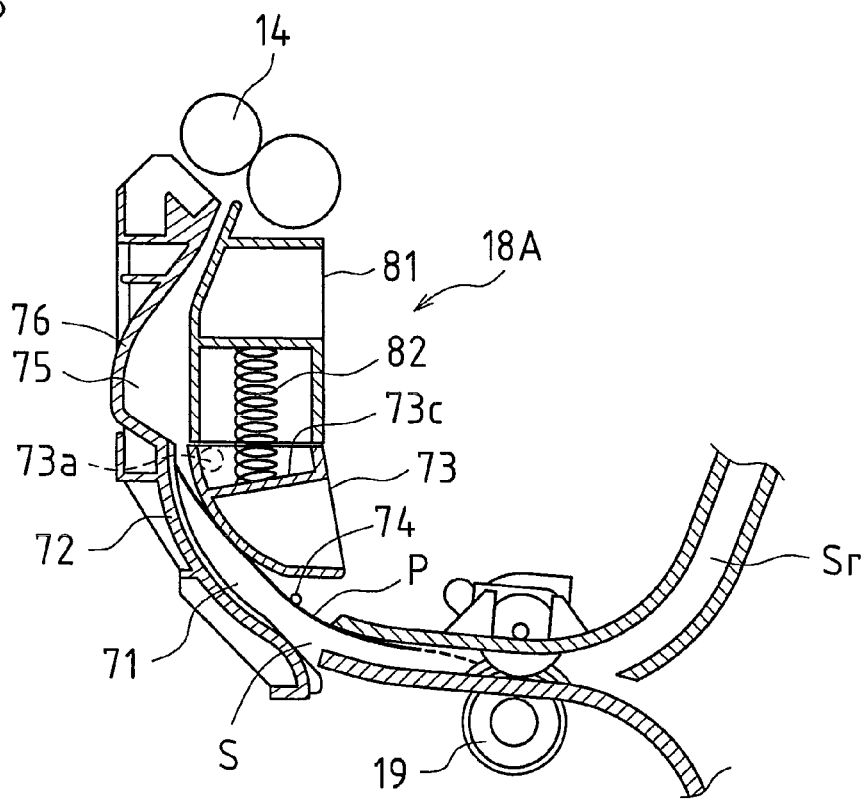
FIG. 3B is a diagram illustrating a cardboard recording sheet of about 200 g/m$^2$ (grammage) passing through the curved portion of the sheet transport path of FIG. 2.

When a cardboard recording sheet P of about 200 g/m$^2$ (grammage) is transported to the curved portion 71 as shown in FIG. 3B, because of the inflexibility of the recording sheet P, the recording sheet P cannot be sufficiently flexed along the curved portion 71. Thus, the recording sheet P presses on the inner guide 73; the inner guide 73 is displaced by being rotated in the anti-clockwise direction around the pins 73*a* against the elasticity of the coiled spring 82; and the inner guide 73 is alienated from the outer guide 72, widening the path width of the curved portion 71.

As a result, even if the recording sheet P is not sufficiently flexed, the recording sheet P passes through the curved portion 71 smoothly. In addition, because the outer guide 72 is fixed, the recording sheet is guided while sliding along the wall face of the outer guide 72. Thus, the transportation precision of the recording sheet P is not reduced.

The recording sheet P thus passes through the curved portion 71, and then the recording sheet P passes through the flexure space 75, and the leading edge of the recording sheet P abuts the registration rollers 14. At this time, rotation of the registration rollers 14 has been temporarily stopped; the transportation of the recording sheet P by the pre-registration rollers 19 continues while the leading edge of the recording sheet P abuts the registration rollers 14; the recording sheet P is flexed in the flexure space 75; and the leading edge of the recording sheet P is aligned parallel to the registration rollers 14 due to the flexibility of the flexed recording sheet P. Afterwards, the registration rollers 14 are driven to rotate, and the recording sheet P is transported by the registration-rollers. 14. Thus, the recording sheet P is prevented from obliquely passing through the nip region between the intermediate transfer belt 7 and the secondary transfer apparatus 11.

As described, because the curved portion 71 of the sheet transport path S is formed between the outer guide 72 and the inner guide 73, and the inner guide 73 is supported by the pins 73*a* so as to be swingable, the inner guide 73 is pressed by the recording sheet P and displaced so that the path width of the curved portion 71 is widened when an inflexible recording sheet P passes through the curved portion 71, even an inflexible recording sheet P can pass through the curved portion 71 smoothly, and sheet blockage does not easily occur.

Next, a configuration for removing sheets that are blocked in the sheet transport path S is described. Although some works have been incorporated also at other portions to avoid easily causing sheet blockage in addition to the curved portion 71 in the sheet transport path S, still, sheet blockage sometimes occurs due to double-feeding, wrinkles, slipping, and the like of the sheet.

Thus, a side wall 83 at the side where the sheet transport path S is provided is made so that it can be opened in the apparatus main unit A of FIG. 1. The side wall 83 is supported in the proximity of the lower end thereof by a shaft 83*a*, and the side wall 83 can be opened by rotating the side wall 83 in the clockwise direction around the shaft 83*a*. At this time, because the sheet transport path S has been opened, the sheet blocked in the sheet transport path S can be easily removed. Afterwards, the side wall 83 is closed by rotating the side wall 83 around the shaft 83*a* in the anti-clockwise direction.

Meanwhile, when the sheet transport path S is in an open state, the proximity of the inner guide 73 in FIG. 2 is also open. At this time, supposing that a user can touch the coiled spring 82 that is biasing the inner guide 73, the coiled spring 82 may be removed and the coiled spring 82 itself may be damaged by careless operations and the like, causing failures in the apparatus.

Thus, in the sheet transport apparatus 18 of this embodiment, the coiled spring 82 biasing the inner guide 73 is attached without being substantially exposed, so that the coiled spring 82 is not removed and the coiled spring 82 itself is not damaged by careless operations and the like.

Figure 4:
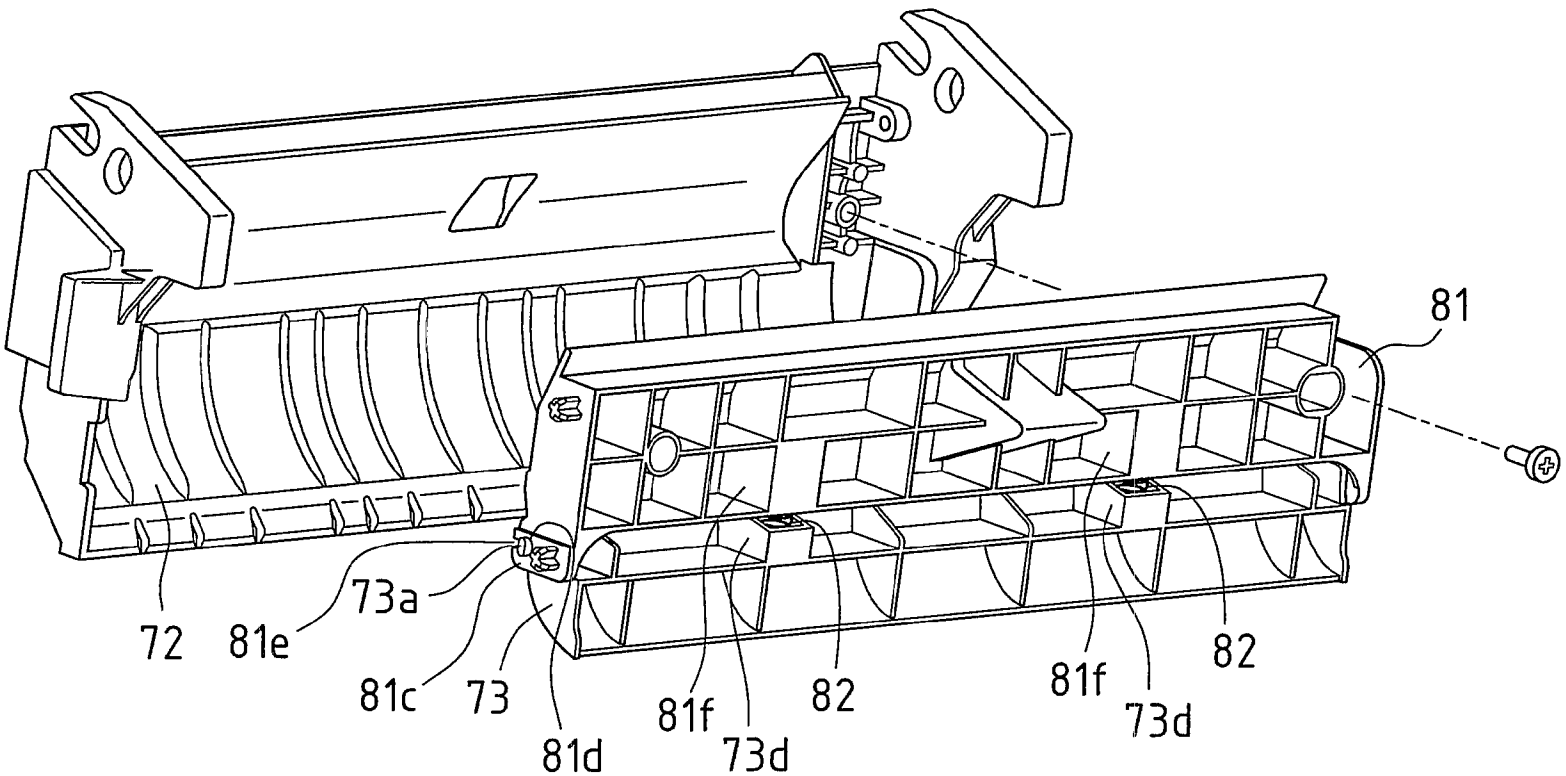
FIG. 4 is an exploded perspective view illustrating an outer guide, an inner guide, and a support frame, viewed from the rear side, in the sheet transport apparatus of FIG. 2.
Figure 5:
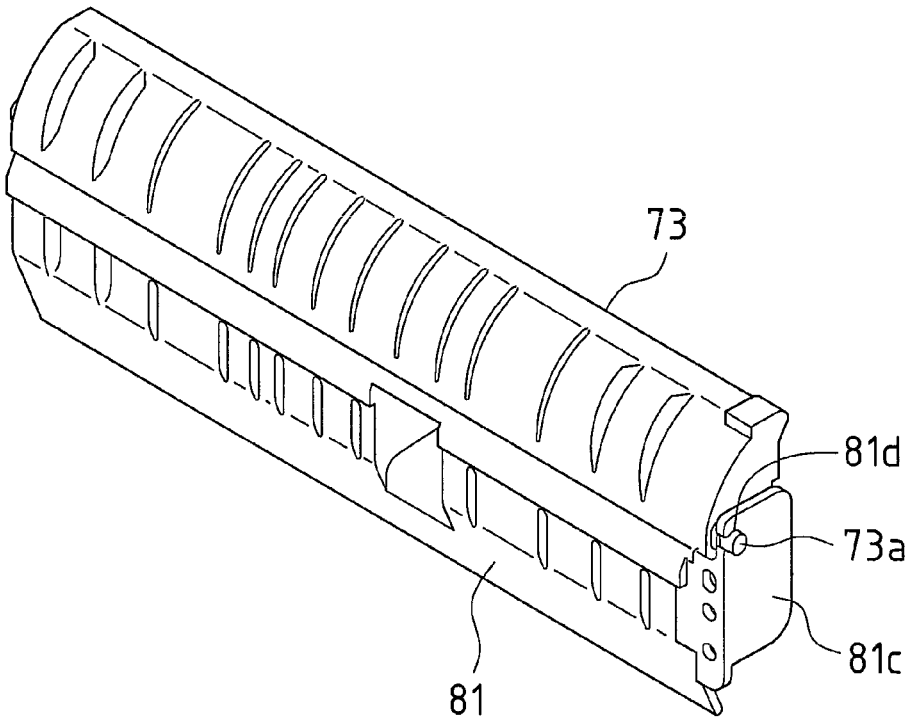
FIG. 5 is a perspective view illustrating the inner guide and the support frame of FIG. 4, upside down.
Figure 6:
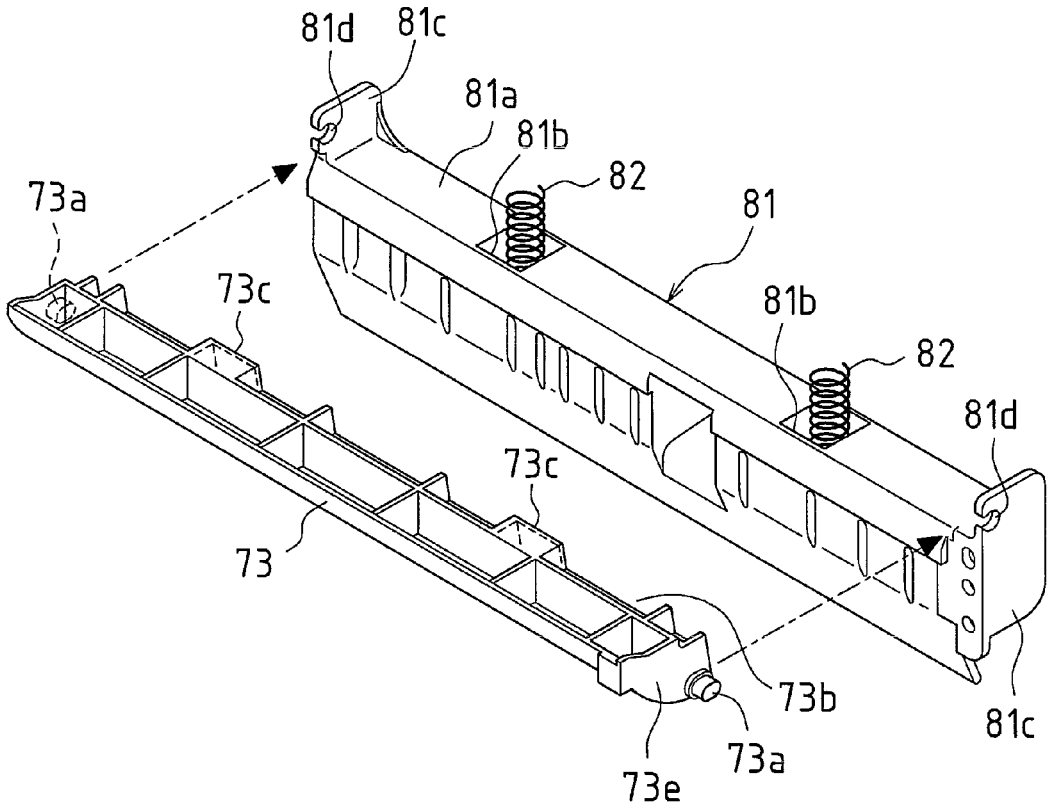
FIG. 6 is an exploded perspective view of the inner guide and the support frame of FIG. 4, upside down.
Figure 7:
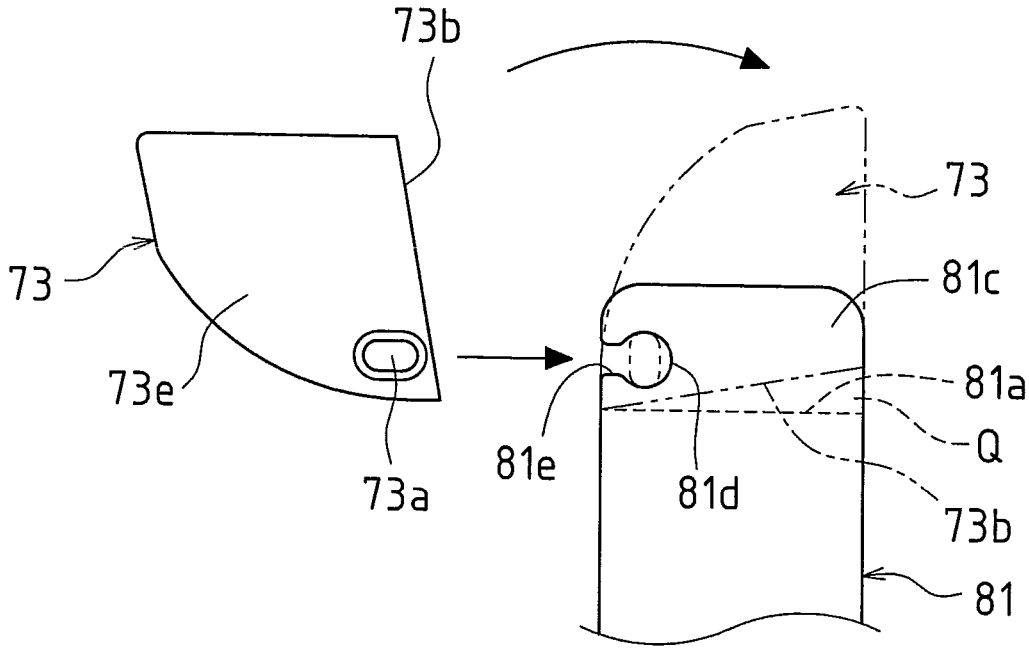
FIG. 7 is a side view illustrating a joint portion, with enlargement, of the inner guide and the support frame of FIG. 4.

Next, a positional configuration of the coiled spring 82 is described with reference to FIG. 2 and FIG. 4 to FIG. 7. FIG. 2 is a cross-sectional view illustrating the inner guide 73 and the support frame 81. FIG. 4 is an exploded perspective view illustrating the outer guide 72, the inner guide 73, and the support frame 81 viewed from the rear side. FIG. 5 is a perspective view illustrating the inner guide 73 and the support frame 81, upside down. FIG. 6 is an exploded perspective view illustrating the inner guide 73 and the support frame 81, upside down. FIG. 7 is a side view illustrating a joint portion, with enlargement, of the inner guide 73 and the support frame 81.

As shown in FIG. 2 and FIG. 4 to FIG. 7, two recess portions 73*c* are formed at the upper face 73*b* of the inner guide 73, and the pins 73*a* project in the horizontal direction from side walls 73*e* on both sides of the inner guide 73.

Also, two recess portions 81*b* are formed on a bottom face 81*a* of the support frame 81. Furthermore, side walls 81*c* on both sides of the support frame 81 project toward the side of the bottom face 81*a*, and bearing holes 81*d* are formed on these side walls 81*c*.

The pins 73*a* at both sides of the inner guide 73 are inserted into the bearing holes 81*d* on both sides of the support frame 81, thereby coupling the inner guide 73 and the support frame 81. The recess portions 73*c* on the upper face 73*b* of the inner guide 73 are open at their upper portion, and the recess portions 81*b* at the bottom face 81*a* of the support frame 81 are open at their lower portion. The recess portions 73*c* of the inner guide 73, and the recess portions 81*b* of the support frame 81 are provided so as to face each other, and the coiled springs 82 are fitted in the recess portions 73*c* and the recess portions 81*b*. Therefore, two coiled springs 82 are provided between the inner guide 73 and the support frame 81, but these coiled springs 82 are covered and hidden inside the recess portions 73*c* and the recess portions 81*b*.

Next, the steps of assembling the inner guide 73 and the support frame 81 are described. First, as shown in FIG. 6, one end of the two coiled springs 82 is fitted in and supported by the two recess portions 81*b* at the bottom face 81*a* of the support frame 81.

Then, as shown in FIGS. 6 and 7, the pins 73*a* at both sides of the inner guide 73 are inserted in the bearing holes 81*d* on the side walls 81*c* at both sides of the support frame 81. The pins 73*a* at both sides of the inner guide 73 are made flat by cutting out opposite sides of a column.

Also, a cut-out 81*e* that is in communication with the bearing hole 81*d* is formed in the side walls 81*c* at both sides of the support frame 81. The opening width of the cut-out 81*e* is made smaller than the diameter of the bearing hole 81*d*, and slightly wider than the thickness of the flat portion of the pins 73*a* of the inner guide 73. Therefore, as shown in FIG. 7, the pins 73*a* at both sides of the inner guide 73 can be passed through the cut-out 81*e* of the bearing hole 81*d* at both sides. Then, the inner guide 73 is rotated 90 degrees around the pins 73*a*, so that the pins 73*a* of the inner guide 73 cannot be removed from the bearing hole 81*d* in both sides. At this time, the upper face 73*b* of the inner guide 73 is laid on the bottom face 81*a* of the support frame 81 so as to face each other, and the other ends of the two coiled springs 82 are fitted in the recess portions 73*c* of the upper face 73*b* of the inner guide 73.

Under such a state, one end of the coiled spring 82 is fitted in and supported by the recess portions 81*b* of the bottom face 81*a* of the support frame 81, and the other end of the coiled spring 82 is fitted in and supported by the recess portions 73*c* of the upper face 73*b* of the inner guide 73.

Afterwards, as shown in FIG. 4, the cut-outs 81*e* of the bearing holes 81*d* in the side walls 81*c* at both sides of the support frame 81 are directed toward the side of the outer guide 72, and the support frame 81 is attached and fixed to the outer guide 72 using a screw. At this time, as shown in FIG. 2, the inner guide 73 abuts the stopper 74 at the side of the outer guide 72, and a gap is formed between the support frame 81 and the inner guide 73, and the outer guide 72, and the gap becomes the sheet transport path S.

Furthermore, a clearance space Q of the inner guide 73 is formed between the upper face 73*b* of the inner guide 73 and the bottom face 81*a* of the support frame 81 so that the inner guide 73 can rotate in the anti-clockwise direction around the pins 73*a* and be displaced against the elasticity of the coiled spring 82. The clearance space Q is formed by slightly inclining the upper face 73*b* of the inner guide 73 from the side of the pins 73*a* toward the lower portion.

When the support frame 81 is thus attached to the outer guide 72, the coiled springs 82 are fitted in and supported by the recess portions 81*b* at the bottom face 81*a* of the support frame 81 and the recess portions 73*c* at the upper face 73*b* of the inner guide 73. In other words, most parts of the coiled springs 82 are enclosed in the recess portions 81*b* of the support frame 81 and the recess portions 73*c* of the inner guide 73, and are covered and hidden by the side walls 81*f* of the recess portions 81*b* and the side walls 73*d* of the recess portions 73*c*. Therefore, the coiled springs 82 are barely exposed even if the side wall 83 of the apparatus main unit A is opened and the proximity of the sheet transport path S and the inner guide 73 becomes open, and the coiled springs 82 are not removed and the coiled springs 82 themselves are not damaged by careless operations and the like.

Furthermore, the operation of mounting the coiled springs 82 is simple and easy because the coiled springs 82 are disposed inside the recess portions 81*b* of the support frame 81 and the recess portions 73*c* of the inner guide 73 by fitting one end of the coiled springs 82 in the two recess portions 81*b* at the bottom face 81*a* of the support frame 81, inserting the pins 73*a* at both sides of the inner guide 73 into the bearing hole 81*d* in the side wall 81*c* on both sides of the support frame 81, and rotating the inner guide 73 so as to allow the upper face 73*b* of the inner guide 73 and the bottom face 81*a* of the support frame 81 to face each other.

Furthermore, because the cut-outs 81*e* of the bearing holes 81*d* in both sides of the support frame 81 face toward the outer guide 72 when the support frame 81 is attached to the outer guide 72, the movement of the pins 73*a* of the inner guide 73 in the direction of removal from the cut-outs 81*e* is inhibited, and the inner guide 73 cannot be removed. Thus, removal of the coiled springs 82 becomes difficult.

Needless to say, although preferable embodiments of the present invention are described above with reference to the attached drawings, the present invention is not limited to such examples. The present invention can be embodied in other different forms without departing from the spirit and essential characteristics thereof. Therefore, the above-described embodiments are considered in all respects as illustrative and not restrictive. The scope of the present invention is indicated by the appended claims rather than by the foregoing description. All variations and modifications falling within the range of equivalency of the appended claims are intended to be embraced therein.

What is claimed is:

1. A sheet transport apparatus, comprising:

a guide member having a convex surface that forms a portion of a sheet transport path in conjunction with an opposing fixed guide member having a concave surface, the guide member being elastically positioned by a spring, wherein a first recess portion for supporting one end of the spring is formed in a first face of the guide member, a second recess portion for supporting the other end of the spring is formed in a second face of a support member of the guide member that opposes the first face, the support member swingably supporting the guide member around pins, the spring is disposed and enclosed inside the first recess portion of the guide member and the second recess portion of the support member, thereby sandwiching the spring between the guide member and the support member, the first face is slanted with respect to the second face, and only a clearance space necessary for the guide member to rotate around the pins and be displaced toward the support member against elasticity of the spring, in accordance with a stiffness of a sheet transported in the sheet transport path making contact with the convex surface and the concave surface, is provided between the first face and the second face, such that only a portion of the spring is exposed through the clearance space, the other portion of the spring is covered by the first recess portion and the second recess portion, in side view, the pins are provided at positions between a bottom surface of the first recess portion and the first face, and overlapping the first recess portion, and the first face comes into contact with the second face such that the first recess portion communicates with the second recess portion.

2. The sheet transport apparatus according to claim 1, wherein the guide member is attached to the support member so as to rotate around the pins, and the spring is disposed and enclosed inside the first and second recess portions by disposing one end or the other end of the spring in the first recess portion of the guide member or in the second recess portion of the support member, and then rotating the guide member around the pins so that the first recess portion of the guide member and the second recess portion of the support member face each other.

3. The sheet transport apparatus according to claim 1, wherein the guide member is removably attached to the support member, and the guide member is prohibited from moving in directions of removal from and attachment to the support member when the support member is attached to an apparatus main unit.

4. The sheet transport apparatus according to claim 1, wherein a proximity of the guide member can be opened for maintenance of the apparatus.

5. The sheet transport apparatus according to claim 1, wherein when a cardboard recording sheet of substantially 200 $g/m^2$ (grammage) is transported in the sheet transport path, the guide member rotates around the pins and is displaced toward the support member against elasticity of the spring such that the entire spring is covered by the first recess portion and the second recess portion.

6. The sheet transport apparatus according to claim 1, wherein the second recess portion has a square pillar shape.

7. A sheet transport apparatus, comprising:

a guide member having a convex surface that forms a portion of a sheet transport path in conjunction with an opposing fixed guide member having a concave surface;

a support member that swingably supports the guide member around pins; and a spring provided between the guide member and the support member for elastically positioning the guide member, wherein the guide member has a first face that defines a first recess portion that receives a first end of the spring, the support member has a second face that defines a second recess portion that receives a second end of the spring, opposite to the first end, the first face is slanted with respect to the second face, and only a clearance space necessary for the guide member to rotate around the pins and be displaced toward the support member against elasticity of the spring, due to a stiffness of a sheet transported in the sheet transport path making contact with the convex surface and the concave surface, is provided between the first face and the second face, such that only a portion of the spring is exposed through the clearance space, the other portion of the spring is covered by the first recess portion and the second recess portion, in side view, the pins are provided at positions between a bottom surface of the first recess portion and the first face, and overlapping the first recess portion, and the first face comes into contact with the second face such that the first recess portion communicates with the second recess portion.

8. The sheet transport apparatus according to claim 7, wherein the second recess portion has a square pillar shape.

* * * * *